US006830129B1

(12) United States Patent
Rose

(10) Patent No.: US 6,830,129 B1
(45) **Date of Patent: *Dec. 14, 2004**

(54) DRYWALL BENCH STEP

(76) Inventor: Mack Rose, 5405 Frank Rd., North Canton, OH (US) 44720

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 246 days.

(21) Appl. No.: 09/354,203

(22) Filed: Jul. 15, 1999

(51) Int. Cl.[7] ..... E04G 1/00
(52) U.S. Cl. ..... 182/129; 182/92; 182/153
(58) Field of Search ..... 182/92, 150, 120, 182/121, 129, 153

(56) References Cited

U.S. PATENT DOCUMENTS

| | | | | | |
|---|---|---|---|---|---|
| 257,463 | A | * | 5/1882 | Boyd | 182/122 |
| 2,581,027 | A | * | 1/1952 | Keest | 182/122 |
| 3,404,751 | A | * | 10/1968 | Nosworthy | 182/92 |
| 3,930,562 | A | * | 1/1976 | Zorn | 182/100 |
| 4,222,136 | A | * | 9/1980 | Valentino | 182/32 |
| 4,405,141 | A | * | 9/1983 | Jurek | 248/214 |
| 4,605,098 | A | * | 8/1986 | Leuty | 182/92 |
| 4,782,916 | A | * | 11/1988 | Hays | 182/32 |
| 4,911,264 | A | * | 3/1990 | McCafferty | 182/92 |
| 5,799,961 | A | * | 9/1998 | Schmeets | 182/92 |

FOREIGN PATENT DOCUMENTS

| | | | | |
|---|---|---|---|---|
| CH | 127182 | * | 8/1928 | 182/120 |
| FR | 240 7330 | * | 6/1979 | 182/206 |
| IT | 500655 | * | 11/1954 | 182/92 |

* cited by examiner

*Primary Examiner*—Alvin Chin-Shue
(74) *Attorney, Agent, or Firm*—Renner, Kenner, Greive, Bobak, Taylor & Weber

(57) ABSTRACT

A bench step to aid in mounting a bench platform provided by the common drywall bench is provided having a support portion adapted to be fit over a step rail provided by the drywall bench, the support portion being held in place on the step rail by a flange that extends from the support portion. A spacer portion extends from the support portion to distance the support portion from a step portion that extends out from the spacer portion. The step portion is provided with structural support by a step support portion that angles downwardly from the step portion to contact the drywall bench and thereby support the step portion. While the bench platform provided by the common drywall bench is usually accessed by stepping from the floor to a step rail provided by the bench and then subsequently stepping from the step rail to the bench platform, the bench step of the present invention facilitates access to the bench platform by providing, by means of the step portion, an intermediate step between the floor and the step rail. Preferably, to provide structural integrity, the bench step is formed from a single sheet of metal, such as aluminum, with each element of the bench step being formed by means of a bend in the metal.

4 Claims, 3 Drawing Sheets

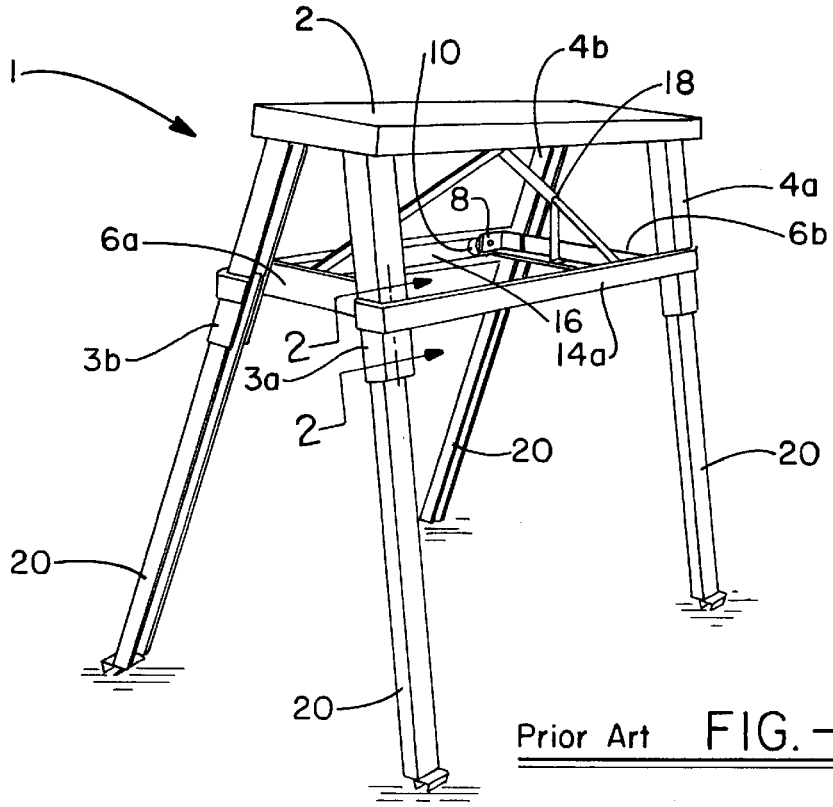
Prior Art FIG.-1
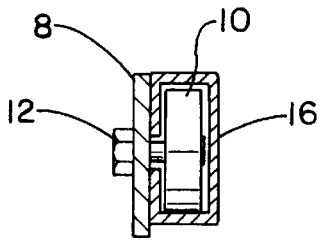
FIG.-2
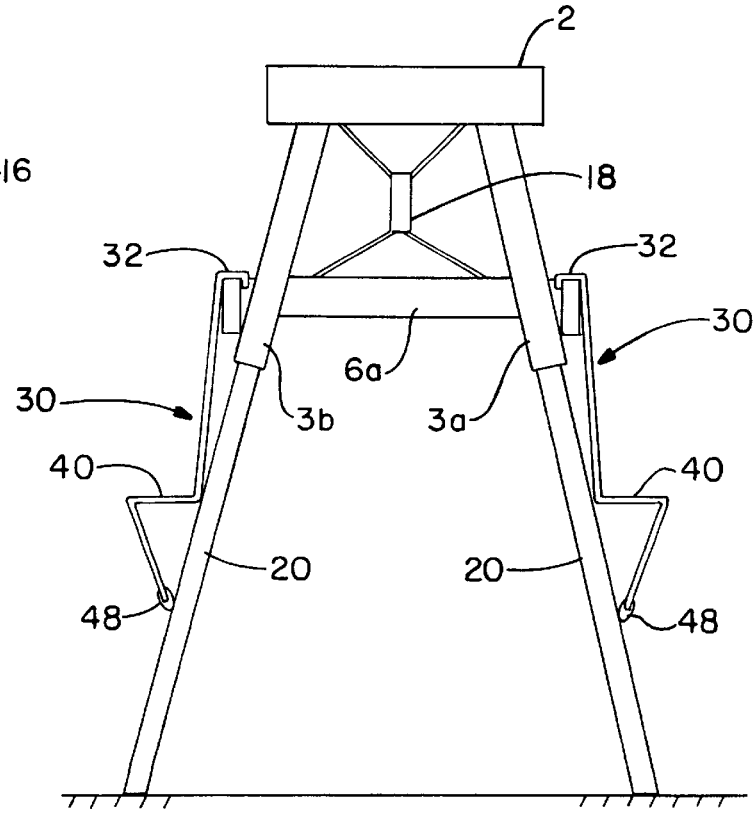
FIG.-4

DRYWALL BENCH STEP

TECHNICAL FIELD

The present invention generally resides in the art of drywall benches. More particularly, the present invention relates to a step that attaches to a drywall bench so as to provide an intermediate platform that one may utilize to reach the top platform provided by the bench. The step of the present invention also provides the drywall bench on which it is used with a safety feature that substantially lessens the likelihood that the drywall bench will collapse when supporting a load.

BACKGROUND ART

Drywall benches such as those described hereinbelow are commonly employed to aid in the placement of drywall sheets in the ceiling of a room. Referring now to FIG. 1, it can be seen that the common drywall bench is designated generally by the numeral 1. Drywall bench 1 provides an elevated bench platform 2 which is generally of rectangular shape. Folding legs 3*a*, 3*b*, 4*a*, 4*b* are pivotally attached (not shown) to the underside of bench platform 2 near the corners thereof. Support rails 6*a* and 6*b* are respectively connected between pairs of folding legs 3*a*, 3*b* and 4*a*, 4*b*, beneath opposite ends of bench platform 2. The ends of support rails 6*a* and 6*b* extend beyond folding legs 3*a*, 3*b*, 4*a*, 4*b* and provide brackets 8 that, as can perhaps be best seen in FIG. 2, retain rollers 10 by means of an associated pin assembly 12. A pair of step rails 14*a*, 14*b* receive rollers 10 associated with opposite sides of the bench platform 2 such that step rail 14*a* connects between folding legs 3*a* and 4*a* and step rail 14*b* connects between folding legs 3*b* and 4*b*. Step rails 14*a* and 14*b* each provide a track 16 with which rollers 10 communicate so that associated pairs of folding legs 3*a*, 3*b* and/or 4*a*, 4*b* may be pivoted from an operative position, as shown in FIG. 1, to a storage position (not shown) in which folding legs 3*a*, 3*b* and 4*a*, 4*b* are pivoted inwardly and upwardly towards the underside of bench platform 2. As folding legs 3*a*, 3*b* and 4*a*, 4*b* are pivoted between the operative and storage positions, rollers 10 move along the length of track 16 such that, although step rails 14*a*, 14*b* are supported by support rails 6*a*, 6*b* and their associated rollers 10, step rails 14*a*, 14*b* do not interfere with the movement of support rails 6*a*, 6*b* and their associated folding legs 3*a*, 3*b* and 4*a*, 4*b*.

A pair of locking braces 18*a*, 18*b* are provided between bench platform 2 and folding legs 3*a*, 3*b* and 4*a*, 4*b*, respectively, so that associated pairs of folding legs 3*a*, 3*b* or 4*a*, 4*b* may be locked into the operating position. Unlocking locking brace 18*a* will allow for the pivotal movement of folding legs 3*a*, 3*b* while unlocking locking brace 18*b* will allow for the pivotal movement of folding legs 4*a*, 4*b*.

Folding legs 3*a*, 3*b*, 4*a*, 4*b* receive telescoping legs 20 which serve to adjust the height at which bench platform 2 is maintained. To provide access to a common eight foot ceiling, shorter telescoping legs 20 are employed, while longer telescoping legs 20 are employed to provide access to higher ceilings. Folding legs 3*a*, 3*b*, 4*a*, 4*b* provide apertures 22 which allow for the selective height adjustment of telescoping legs 20. Telescoping legs 20 are also provided with apertures (not shown) such that the apertures on telescoping legs 20 may be placed in registration with apertures 22 on folding legs 3*a*, 3*b*, 4*a*, 4*b* and subsequently locked into place by inserting a bolt or pin mechanism (not shown) through the apertures thus aligned. Various other means for securing telescoping legs 20 to folding legs 3*a*, 3*b* and 4*a*, 4*b* are utilized in the common drywall bench, however, the specific disclosure of such securing means is not pertinent to the disclosure of the present invention.

Drywall bench 1 thus provides a bench platform 2, the height of which may be adjusted according to the height of the ceiling to which access is desired. Once drywall bench 1 is set to the desired height, the bench platform 2 is reached by first stepping from the floor to step rail 14*a* or 14*b* and subsequently stepping from that step rail 14*a*, 14*b* to bench platform 2. However, step rail 14*a*, 14*b* is quite narrow and is positioned at a substantial height from the floor, making it very difficult to access bench platform 2 in the manner just described, especially, as is commonly the case, when carrying a large, heavy drywall sheet. The difficulty encountered in accessing step rails 14*a*, 14*b* from the floor has caused many persons that work with the common drywall bench 1 to place a bucket or other supplemental step on the floor so that an intermediate step between the floor and one of step rails 14*a* or 14*b* is provided.

Providing an intermediate step, such as a bucket, while facilitating access to bench platform 2, creates its own set of problems. First, many devices used as intermediate steps, such as buckets, may provide surfaces that are unsafe to stand upon. They may fail to provide the requisite structural stability, may provide irregularly shaped platforms, or may otherwise be structurally inadequate to serve as a platform to stand upon. Second, these intermediate steps are not in any way attached to the drywall bench 1 and therefore must be properly aligned in relation to the drywall bench 1 whenever the position of the drywall bench 1 is altered. Also, these steps occupy floor space such that they may be tripped over or knocked out of alignment with drywall bench 1 or otherwise present an inconvenience.

Nevertheless, the employment of such intermediate steps has become common practice in the field despite the fact this unsafe practice has caused many personal injuries as well as damage to sheets of drywall, driving up costs and resulting in decreases in productivity. Thus, there exists a need in the art for the addition of an intermediate step to the basic drywall bench that substantially eliminates the problems associated with trying to mount the bench platform.

Other safety concerns are also relevant when considering the design of the drywall benches 1 of the prior art. As mentioned above, folding legs 3*a*, 3*b* and 4*a*, 4*b* are maintained in the operative position by locking braces 18*a*, 18*b*. Thus, if either of the locking braces 18*a*, 18*b* is not properly locked or is accidentally contacted so as to occupy an unlocked position, folding legs 3*a*, 3*b* and/or 4*a*, 4*b* associated with that locking brace 18*a* and/or 18*b* will be able to pivot to the storage position. If one tries to mount the bench platform 2 of drywall bench 1 while either of the locking brakes 18*a*, 18*b* is in an unlocked position, folding legs 3*a*, 3*b* or 4*a*, 4*b* associated with the unlocked locking braces 18*a* or 18*b* will tend to pivot when weight is applied to step rail 14*a* or 14*b* or bench platform 2, and drywall bench 1 will collapse. Obviously, the collapsing of drywall bench 1 is undesirable due to safety concerns. Moreover, an unlocked brace 18*a*, 186 may allow the bench 10 to simply collapse when being moved, subjecting the user to pinched fingers and hands. It has been found that the provision of a drywall bench step as hereinafter described and claimed, in addition to providing an intermediate step in order to mount the bench platform, also introduces a safety feature into the drywall bench to which it is fitted by substantially eliminating the possibility that the drywall bench will collapse even when both locking braces of the drywall bench are in an unlocked position.

DISCLOSURE OF THE INVENTION

In light of the foregoing, it is an aspect of the present invention to provide a drywall bench step that can be fit onto the common drywall bench.

It is another aspect of the present invention to provide a drywall bench step that is structurally stable so as to be capable of sustaining the heavy loads typically supported by drywall benches.

It is a further aspect of the present invention to provide a drywall bench step that provides a substantially flat surface of substantial size so that one using the drywall bench step is not likely to accidently fall off.

It is yet another aspect of the present invention to provide a drywall bench step that is simple to set up and tear down.

It is an additional aspect of the present invention to provide a drywall bench step that provides an added safety feature by substantially decreasing the possibility of collapse of the drywall bench.

These and other aspect of the present invention which will become apparent from the description which follows are attained by a bench step for a drywall bench having a bench step for a drywall bench having a bench platform, folding legs pivotally connected to the bench platform, support rails connected between the folding legs and including brackets having rollers rotatably received thereon, step rails receiving the rollers and thereby connecting between the support rails such that the folding legs connected to the support rails may be pivoted between operative and storage positions, the rollers being capable of moving within a track provided by the support legs such that the associated support legs and folding legs remain connected as the folding legs are pivoted, locking braces connected between the bench platform and the support rails to selectively lock the folding legs into the operative position, and telescoping legs selectively received by the folding legs, the step comprising: a support portion adapted to be received by at least a portion of one of the step rails; a spacer portion extending downwardly from said support portion; a step portion extending from said spacer portion such that said step portion lies substantially parallel to the bench platform when the bench step is placed on one of the step rails of the drywall bench.

Other aspects of the invention are attained by the improvement in a drywall bench having a bench platform, folding legs pivotally connected to the bench platform, support rails connected between the folding legs and including brackets having rollers rotatably received thereon, step rails receiving the rollers and thereby connecting between the support rails such that the folding legs connected to the support rails may be pivoted between operative and storage positions, the rollers being capable of moving within a track provided by the support legs such that the associated support legs and folding legs remain connected as the folding legs are pivoted, locking braces connected between the bench platform and the support rails to selectively lock the folding legs into the operative position, and telescoping legs selectively received by the folding legs, the improvement comprising: a support portion adapted to be received by at least a portion of one of the step rails, a spacer portion extending downwardly from said support portion, and step portion extending from said spacer portion such that said step portion lies substantially parallel to the bench platform.

A preferred exemplary drywall bench step incorporating the concepts of the present invention is shown by way of example in the accompanying drawings without attempting to show all the various forms and modifications in which the invention might be embodied, the invention being measured by the appended claims and not by the details of the specification.

DESCRIPTION OF THE DRAWINGS

For a complete understanding of the objects, techniques and structure of the invention reference should be made to the following detailed description and accompanying drawings wherein:

FIG. 1 is a perspective view of a drywall bench of the prior art;

FIG. 2 is a cross sectional view of a portion of the drywall bench of FIG. 1 taken along the line 2—2;

FIG. 4 is a front view of a drywall bench having the drywall bench step of the present invention affixed thereto;

PREFERRED EMBODIMENT OF THE INVENTION

Figure 3:
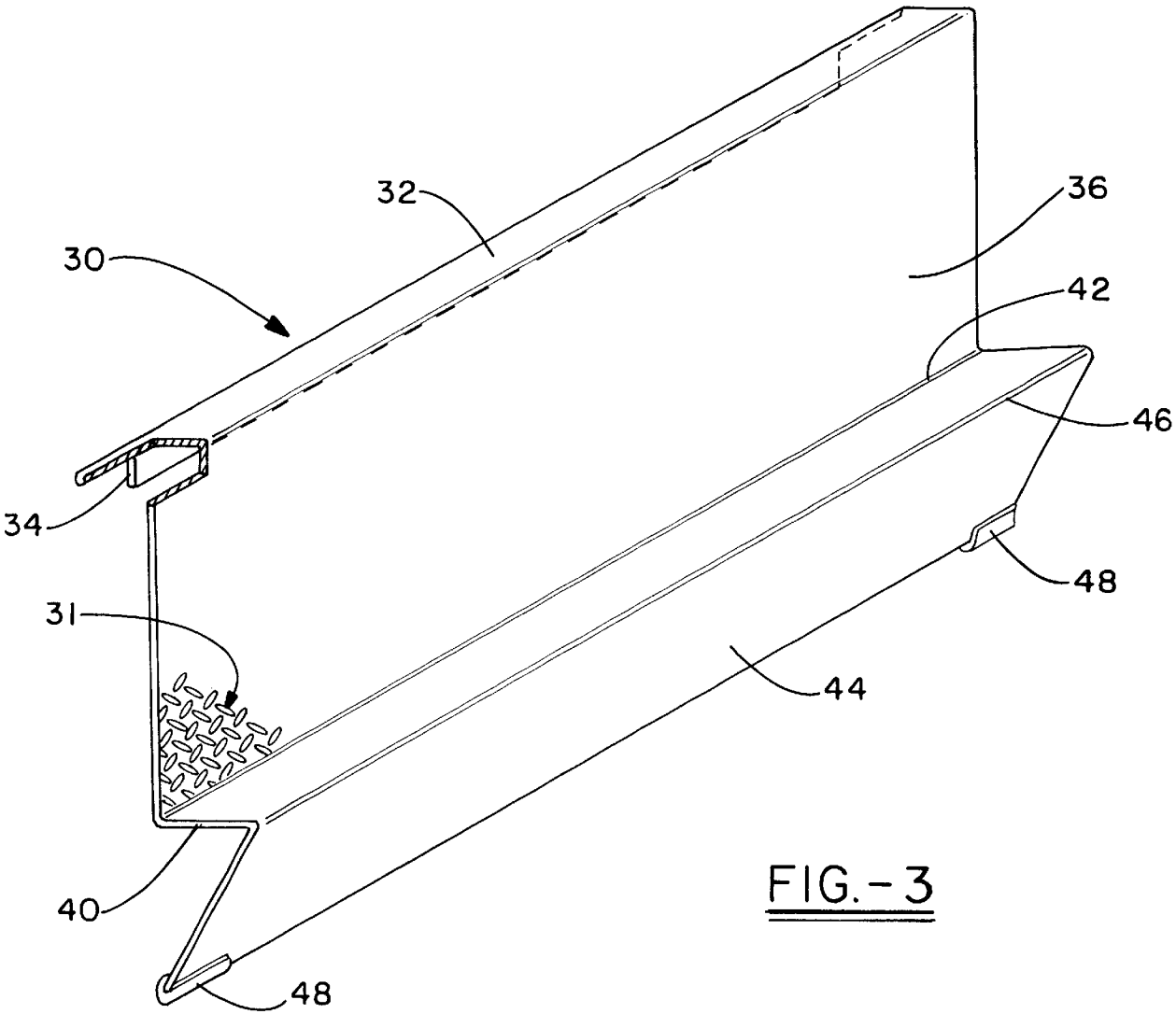
FIG. 3 is a perspective view of the drywall bench step of the present invention.
Figure 5:
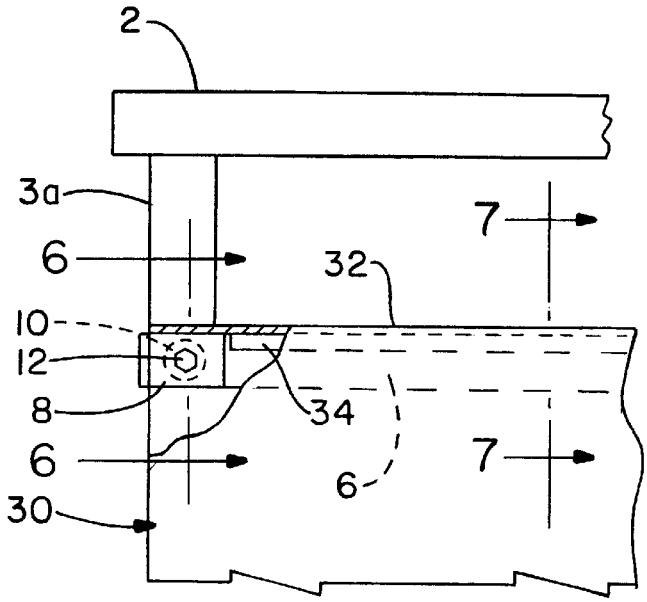
FIG. 5 is a side view of a drywall bench having the drywall bench step of the present invention affixed thereto.
Figure 6:
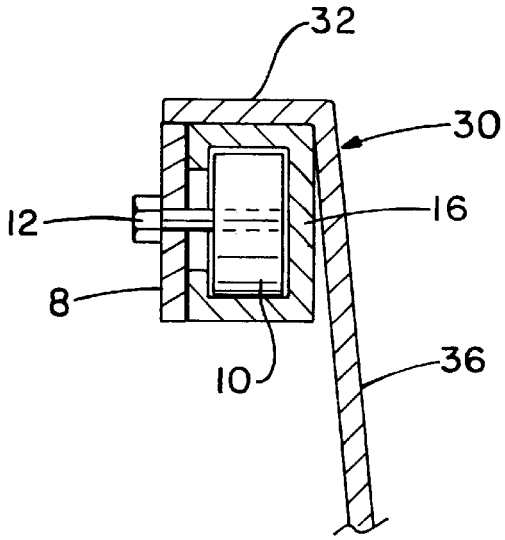
FIG. 6 is a cross sectional view taken along the line 6—6 of FIG. 5, showing how the drywall bench step of the present invention attaches to the common drywall bench.
Figure 7:
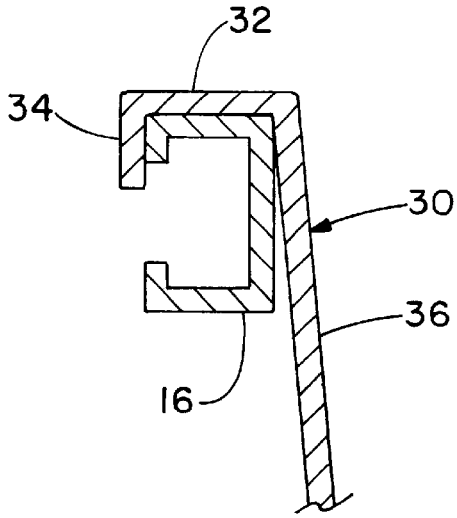
FIG. 7 is a cross sectional view taken along the line 7—7 of FIG. 5, showing how the drywall bench step of the present invention attaches to the common drywall benches.

Referring now to FIG. 3, it can be seen that the drywall bench step of the present invention is designated generally by the numeral 30. While the bench 30 is described herein as a drywall bench, indicating that its use might be limited to installing drywall, it will be appreciated that the concept and structure of the invention is adaptable to benches of various types and uses, and the term "drywall bench" is not intended as limiting. Bench step 30 is preferably constructed from a single sheet of metal or other suitable material. Constructing bench step 30 from a single piece of metal is preferred because each bend placed on a single piece of metal to form the bench step 30 increases the structural integrity of bench step 30 such that its strength is more than adequate for the use to which it is to be employed. Most preferably, bench step 20 is preferably constructed from ⅛th inch thick aluminum having lugs 31 serving to increase the foot grip one can maintain on bench step 30 when bench step 30 is employed as hereinafter disclosed. However, bench step 30 may be constructed from multiple sheets of metal or other suitable materials, with or without lugs 31, and such constructions are deemed within the scope of the present invention. Bench step 30 provides a support portion 32 that is designed to communicate with a step rail 14*a*, 14*b* on the common drywall bench 1, discussed above under Background Art. Referring now to FIGS. 4–7, it can be seen that, in the preferred embodiment of bench step 30, support portion 32 fits over step rail 14 and is held in place by flange 34. However, bench step 30 could be designed to communicate with a step rail 14*a*, 14*b* in alternative ways and therefore, the present invention should not be limited to any particular means of attachment to the common drywall bench 1. Likewise, support portion 32 should not be limited to the particular embodiment shown in the drawings, although it is desired that support portion 32 communicates with a step rail. Preferably, flange 34 is formed by placing bend 35 in the single sheet of metal forming bench step 30. As is perhaps best seen in FIGS. 5–7, flange 34 does not extend down from along the entire length of support portion 32 but is rather cut out, at the ends, in the area of brackets 8, on drywall bench 1, so that brackets 8 do not interfere with the placement of bench step 30 on step rail 14. Because flange 34 fits adjacent to brackets 8, placing bench step 30 on drywall bench 1 prevents folding legs 3*a*, 3*b* and 4*a*, 4*b* from being capable of folding into a storage position because, as rollers 10 begin to traverse track 16 as folding legs 3*a*, 3*b* and 4*a*, 4*b* pivot toward bench platform 2, brackets 8 come into contact with flange 34 and flange 34 becomes wedged between brackets 8 preventing further pivotal movement of folding legs 3*a*, 3*b* and 4*a*, 4*b*. It has been found that this feature of flange 34 is desirable in that it acts as a safety catch or bar for drywall bench 1. If one or both of locking braces 18*a*, 18*b* are accidently caused to occupy an unlocked position, drywall bench 1 would normally collapse as one attempts to mount bench platform 2 because, as weight is applied to bench platform 2, the folding legs 3*a*, 3*b* or 4*a*, 4*b* associated with the unlocked locking brace 18*a* or 18*b* will pivot under that weight, causing drywall bench 1 to collapse. However, as mentioned above, when bench step 30 is mounted on either step rail 14*a* or 14*b*, folding legs 3*a*, 3*b* and 4*a*, 4*b* may only pivot until flange 34 becomes wedged between brackets 8 at opposite ends of the bench. This prevents drywall bench 1 from collapsing even when both locking brackets 18*a*, 18*b* are in an unlocked position. In other words, when the bench step 30 is received on either step rail 14*a* or 14*b*, the flange 34 serves as a spacer between the brackets 8 at opposite ends of the flange, preventing rotation of the associated leg pairs 3*a*, 4*a* and 3*b*, 4*b* any closer to each other than the length of the flange 34.

Of course, the ability of flange 34 to function as a safety catch for drywall bench 1 depends upon the proximity of brackets 8 to flange 34 when bench step 30 is mounted on drywall bench 1. If flange 34 is not in close proximity to bracket 8, folding legs 3*a*, 3*b* or 4*a*, 4*b* may be capable of pivoting to an unstable position before their progress is stopped by the wedging of flange 34 between brackets 8. Thus, it is preferred that flange 34 be constructed so as to lie in close proximity (generally within about an inch) to each of the brackets 8 upon step rail 14*a* or 14*b* to which bench step 30 is mounted.

Opposite flange 34, spacer portion 36 extends from support portion 32 at bend 38. Of course, it should be realized that bench step 30 could communicate with a step rail 14*a*, 14*b* without the need for support portion 32 and flange 34 by, for example, directly fastening the top edge of spacer portion 36 to a step rail 14*a*, 14*b* by means of screws or other fasteners. In such a configuration, the top edge or face of spacer portion 36 would be the support portion of the bench step. However, support portion 32 and flange 34 are preferred because they allow bench step 30 to be selectively placed on and removed from drywall bench 1. Step portion 40 extends from spacer portion 36 and is preferably formed by bend 42 in a single sheet of metal forming bench step 30. Step portion 40 provides an intermediate step by which bench platform 2 may be reached. Therefore, step portion 40 preferably extends from spacer portion 36 at an angle such that step portion 40 lies in the horizontal plane, parallel to bench platform 2.

Although a bench step 30 providing only the structural elements recited hereinabove can adequately perform its intended function, structural support preferably is added to step portion 40 by step support portion 44. Step support portion 44 is preferably formed by placing bend 46 in a single sheet of metal, forming bench step 30. Step support portion 44 is angled downwardly from step portion 40 to contact telescoping legs 20 at a position below step portion 40. Preferably, the portions of step support portion 44 contacting telescoping legs 20 are covered by a rubber sleeve or guard 48 so as to protect the telescoping legs 20 and the step support portion 44 from the wear and tear that may otherwise occur if they were permitted to directly contact each other.

From the figures and descriptions disclosed hereinabove, it should be readily apparent that bench step 30 provides an intermediate step to the basic drywall bench and substantially eliminates the problems associated with trying to mount the bench platform. To mount bench platform 2, one simply steps from the floor to step portion 40 and then subsequently from step portion 40 to support portion 32 fitted over step rail 14*a*, 14*b*. A final step from support portion 32 to bench platform 2 finishes the task. The distance one must step from support portion 32 to bench platform 2 remains substantially identical to the distance one was required to step from step rail 14 to bench platform 2 when using the drywall bench 1 of the prior art. However, when using bench step 30 in conjunction with prior art drywall bench 1, one no longer has to step directly from the floor to step rail 14 in order to mount bench platform 2, because an intermediate step is provided by step portion 40. It should be readily apparent that the distance one must step from the floor to step portion 40 is dependent upon the height of spacer portion 36 as well as the length of telescoping legs 20. The distance one must step from step portion 40 to support portion 32 is dictated solely by the height of spacer portion 36. It should be readily apparent that, for different applications requiring a higher or lower bench platform 2, the dimensions of bench step 30 may be altered so as to provide a more convenient intermediate step by means of step portion 40. Similarly, the width of step portion 40 may be altered to provide greater or lesser support area; however, it is preferred that the width of step portion 40 is such that when two bench steps 30 are placed on the common drywall bench 1, one on each step rail 14*a*, 14*b*, the combination will still be capable of fitting through a doorway of common width, making the drywall bench 1 with attached bench steps 30 highly portable at a work site.

Thus it can be seen that the objects of the invention have been satisfied by the structure presented above. While in accordance with the patent statutes only the best mode and preferred embodiment of the invention has been presented and described in detail, it will be understood that the invention is not limited thereto or thereby. Accordingly, for an appreciation of the true scope and breadth of the invention reference should be made to the following claims.

What is claimed is:

1. In combination a bench step and a drywall bench, said drywall bench comprising a bench platform; folding legs connected to said bench platform; and a step rail connected to said folding legs such that said folding legs may be pivoted between operative and storage positions, said bench step comprising:

a support portion removably received by at least a portion of said step rail and including at least one flange, said support portion and said at least one flange allowing the bench step to be selectively placed on or removed from the drywall bench;

a spacer portion extending downwardly from said support portion; and a step portion extending from said spacer portion such that said step portion lies substantially parallel to said bench platform when the bench step is placed on said step rail of the drywall bench;

wherein said at least one flange fits over said step rail such that said folding legs associated with said step rail are unable to pivot to the storage position because the movement of said folding legs is impeded by said at least one flange.

2. The combination according to claim 1 wherein said support portion, said spacer portion, said step portion, are integrally formed from a single piece of metal.

3. The combination according to claim 2 wherein said single piece of metal is a sheet of eighth inch thick aluminum.

4. In a drywall bench having a bench platform, folding legs pivotally connected to the bench platform, support rails connected between the folding legs and including brackets having rollers rotatably received thereon, step rails receiving the rollers and thereby connecting between the support rails such that the folding legs connected to the support rails may be pivoted between operative and storage positions, the rollers being capable of moving within a track provided by the step rails such that the associated support rails and folding legs remain connected as the folding legs are pivoted, locking braces connected between the bench platform and the support rails to selectively lock the folding legs into the operative position, and telescoping legs selectively received by the folding legs, the improvement comprising:

a support member including at least one flange;

a spacer member extending downwardly from said support member; and a step member extending from said spacer member such that said step member lies substantially parallel to the bench platform;

wherein said at least one flange fits over one of the step rails such that said support portion and said at least one flange can be selectively placed on or removed from a step rail on the drywall bench and wherein said at least one flange fits over one of the step rails, in close juxtaposition to one of the brackets provided by the support rail, such that the folding legs associated with the support rail are unable to pivot to the storage position because movement of the rollers associated with the bracket is impeded as the bracket contacts said at least one flange.

* * * * *